US011129430B2

(12) United States Patent
Luciani

(10) Patent No.: US 11,129,430 B2
(45) Date of Patent: Sep. 28, 2021

(54) APPARATUS FOR APPLYING STUDS

(71) Applicant: GRUPPO MECCANICHE LUCIANI S.R.L., Corridonia (IT)

(72) Inventor: Gianfranco Luciani, Corridonia (IT)

( * ) Notice: Subject to any disclaimer, the term of this patent is extended or adjusted under 35 U.S.C. 154(b) by 271 days.

(21) Appl. No.: 15/241,468

(22) Filed: Aug. 19, 2016

(65) Prior Publication Data

US 2017/0065015 A1 Mar. 9, 2017

(30) Foreign Application Priority Data

Sep. 9, 2015 (IT) ..... 102015000049816

(51) Int. Cl.
*B27F 7/19* (2006.01)
*A41H 37/00* (2006.01)

(52) U.S. Cl.
CPC ..... *A41H 37/00* (2013.01); *B27F 7/19* (2013.01)

(58) Field of Classification Search
CPC ..... A41H 37/00; A61B 2017/07271; A61B 17/068; A61B 17/105; A61B 2017/07278; A61B 2017/0409; A61B 2017/0408; A61B 2017/0419; A61B 2017/0641; F16B 19/002; B27F 7/19; B27F 7/15
USPC ..... 227/175.1–182.1
See application file for complete search history.

(56) References Cited

U.S. PATENT DOCUMENTS 1,094,588 A * 4/1914 O'Brien ..... A41H 37/04 227/141
1,415,330 A * 5/1922 Frankel ..... A41H 37/005 227/36
2,131,347 A * 9/1938 Paule ..... A44B 17/0088 24/681
2,724,162 A * 11/1955 Paule ..... A44B 17/0052 24/681
2,997,715 A * 8/1961 Chapman ..... A41H 37/005 227/141
3,250,450 A * 5/1966 Le Page ..... A41H 37/006 227/144
3,472,442 A * 10/1969 Louis ..... A41H 37/02 227/140
3,734,542 A * 5/1973 Nesmith, Jr. ..... B42F 11/02 281/47
3,746,237 A * 7/1973 Nysten ..... A41H 37/005 227/147
3,794,550 A * 2/1974 Taillie ..... B42C 9/0081 156/277

(Continued)

FOREIGN PATENT DOCUMENTS

DE 2512877 A1 10/1976

*Primary Examiner* — Robert F Long
(74) *Attorney, Agent, or Firm* — Egbert, McDaniel & Swartz, PLLC

(57) ABSTRACT

An apparatus for applying studs on strips of material includes a lower plate having a plurality of upward-protruding pins, an intermediate plate intended to be disposed on the lower plate and having a plurality of through housings suitable for receiving the body of the studs and letting the pins of the lower plate pass through, and an upper plate with housings to cooperate with the attaching means of the studs. The pins of the lower plate have a head made of a soft material intended to stop against the body of the studs, in such manner not to damage the body of the studs, when the studs are pressed between the pins of the lower plate and the housings of the upper plate.

15 Claims, 2 Drawing Sheets

(56) References Cited

U.S. PATENT DOCUMENTS 3,830,524 A * 8/1974 Abildgaard ..... B42B 5/00 156/580.1
4,111,080 A * 9/1978 Pray ..... B25B 31/00 29/243.51
4,113,394 A * 9/1978 Giulie ..... B42F 13/12 402/25
4,134,350 A * 1/1979 Dancso ..... D05B 3/14 112/110
4,144,628 A 3/1979 Schick
4,376,504 A * 3/1983 Birkhofer ..... A41H 37/10 227/32
4,525,116 A * 6/1985 Holmberg ..... B42C 9/00 281/2
4,708,141 A * 11/1987 Inoue ..... A61B 17/1155 227/179.1
4,872,455 A * 10/1989 Pinchuk ..... A61B 17/3201 606/174
4,930,674 A * 6/1990 Barak ..... A61B 17/072 227/179.1
5,102,167 A * 4/1992 Groswith, III ..... B42B 5/08 281/21.1
5,183,196 A * 2/1993 Miyashita ..... B25C 5/025 227/144
5,234,232 A * 8/1993 Fletcher ..... B42F 13/14 281/28
5,407,108 A * 4/1995 Hambright ..... D04D 7/10 223/44
5,413,268 A * 5/1995 Green ..... A61B 17/07207 227/176.1
5,476,204 A * 12/1995 Eisenpresser ..... A41H 37/00 227/119
5,551,622 A * 9/1996 Yoon ..... A61B 17/072 227/176.1
5,593,700 A * 1/1997 Stilgenbauer ..... C14B 11/00 264/294
5,975,398 A * 11/1999 Evans ..... B65C 7/005 227/67
6,139,209 A * 10/2000 Nicol ..... B42D 1/003 281/21.1
6,216,935 B1 * 4/2001 Oussani, Jr. ..... B25C 5/0228 227/131
6,237,828 B1 * 5/2001 Crowley ..... B27F 7/19 227/141
6,983,559 B1 * 1/2006 Kraus ..... A01K 97/18 43/4
7,533,790 B1 * 5/2009 Knodel ..... A61B 17/0684 227/175.1
8,276,801 B2 * 10/2012 Zemlok ..... A61B 90/90 227/176.1
8,348,972 B2 * 1/2013 Soltz ..... A61B 17/0644 606/219
8,617,203 B2 * 12/2013 Stefanchik ..... A61B 17/29 606/207
8,714,596 B1 * 5/2014 Bloomberg ..... B42B 5/06 24/67 P
8,783,542 B2 * 7/2014 Riestenberg ..... A61B 90/92 227/176.1
2003/0130677 A1 * 7/2003 Whitman ..... A61B 17/072 606/167
2004/0131446 A1 * 7/2004 Acquaviva ..... B42F 13/12 412/8
2005/0150928 A1 * 7/2005 Kameyama ..... B25C 1/005 227/120
2007/0114261 A1 * 5/2007 Ortiz ..... A61B 17/064 227/175.1
2008/0078800 A1 * 4/2008 Hess ..... A61B 17/0644 227/175.1
2008/0312687 A1 * 12/2008 Blier ..... A61B 17/0644 606/219
2009/0047057 A1 * 2/2009 Alanis ..... B42F 13/02 402/62
2009/0256300 A1 * 10/2009 Grizzell ..... B25C 5/0235 270/37
2009/0272783 A1 * 11/2009 Crainich ..... A61B 17/0401 227/176.1
2009/0277949 A1 * 11/2009 Viola ..... A61B 17/072 227/178.1
2010/0213240 A1 * 8/2010 Kostrzewski ..... A61B 17/072 227/180.1
2011/0278343 A1 * 11/2011 Knodel ..... A61B 17/07207 227/176.1
2012/0080483 A1 * 4/2012 Riestenberg ..... A61B 90/92 227/176.1
2013/0075448 A1 * 3/2013 Schmid ..... A61B 17/0686 227/176.1
2013/0214030 A1 * 8/2013 Aronhalt ..... A61B 17/0682 227/176.1
2014/0191010 A1 * 7/2014 Tucker ..... B25C 5/1658 227/109
2014/0310926 A1 * 10/2014 Seng ..... B42F 1/00 24/67 R
2016/0058441 A1 * 3/2016 Morgan ..... A61B 17/0644 606/219
2017/0027568 A1 * 2/2017 Scheib ..... A61B 17/07207
2018/0015767 A1 * 1/2018 Kim ..... B25C 5/06
2018/0168633 A1 * 6/2018 Shelton, IV ..... A61B 17/07207

* cited by examiner

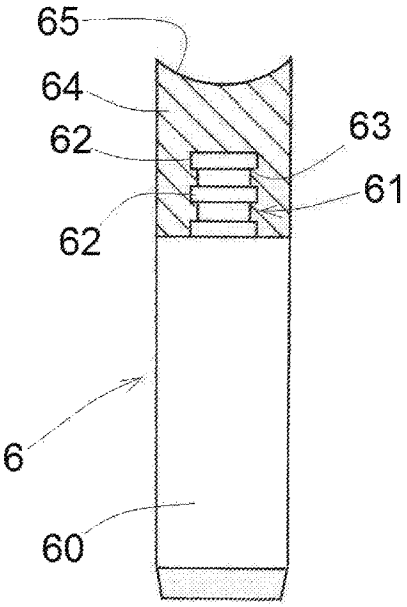
FIG. 2
FIG. 3
FIG. 4
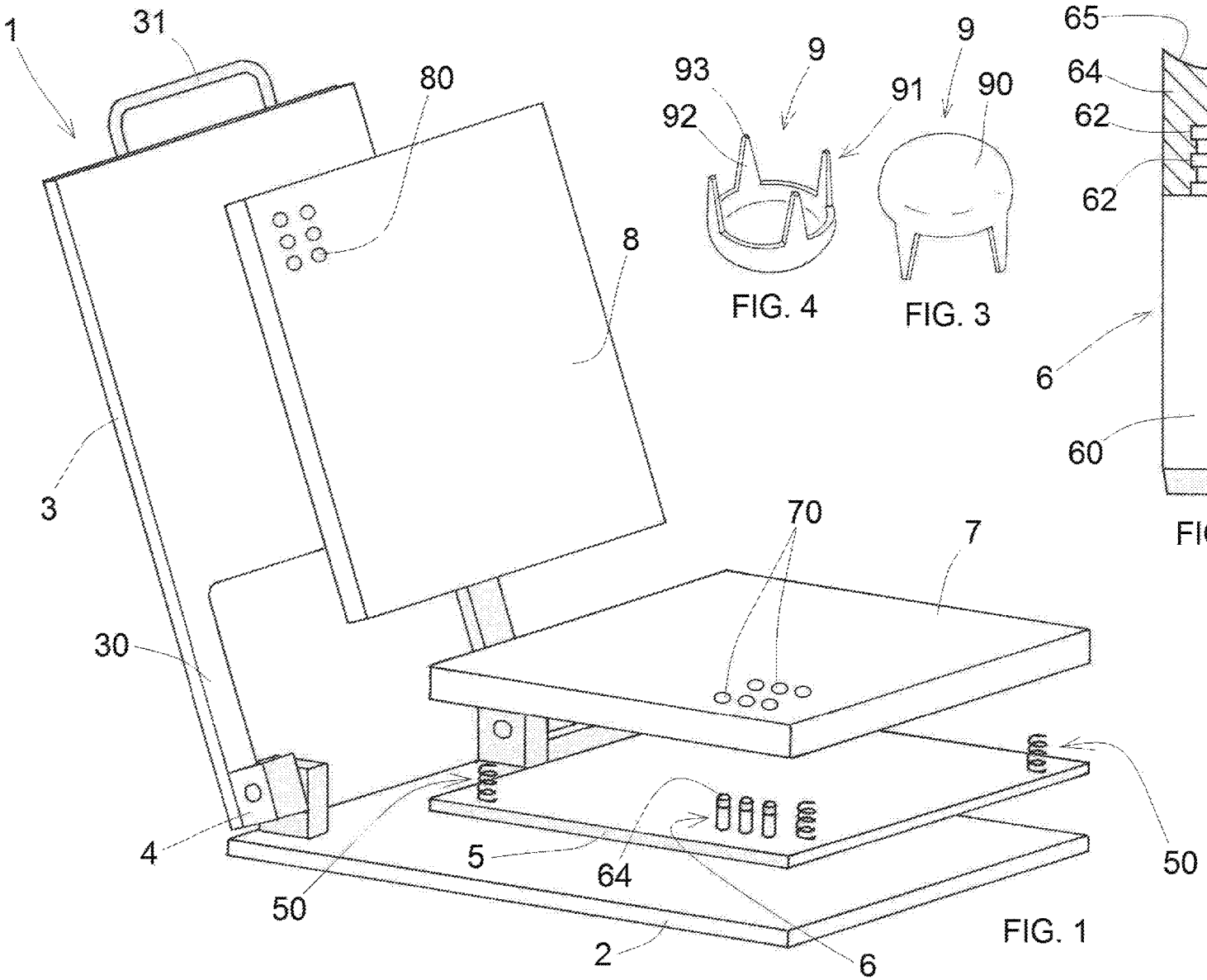
FIG. 1

APPARATUS FOR APPLYING STUDS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to an apparatus for applying studs on strips or sheets of different types of material, such as leather, fabric, cloth, and the like, for the realization of different types of products, such as footwear uppers, bags, accessories, garments, interior decoration items and the like.

2. Description of Related Art Including Information Disclosed Under 37 CFR 1.97 and 37 CFR 1.98

As it is known, decorative studs with different shape and size, which are generally made of metal, are used to decorate leather.

The ordinary studs that are currently applied on leather are made of only one part provided with an attaching element, known as "claw", which comprises a plurality of feet that perforate leather and are bent in order to hold the stud.

An apparatus is known for fixing the studs, which consists in a mold comprising:

- a lower plate provided with upward-protruding pins,
- an intermediate plate disposed on the lower plate and provided with housings in order to receive the body of the studs in such manner that the claws are directed upwards, and
- an upper plate provided with recessed housings that cooperate with the claws in order to bend the claws.

The housings of the intermediate plate are through holes in register with the pins and the recessed housings of the upper plate.

The studs are distributed by hand on the intermediate plate, in such manner that they are inserted in the housings of the intermediate plate with the claws directed upwards. The studs in excess are removed. The strip is disposed on the intermediate plate above the claws of the studs. The mold is closed and the intermediate plate is lowered by the upper plate. Consequently, the pins of the lower plate penetrate the housings of the intermediate plate, holding the studs in position. The claws of the studs perforate the strip and the recessed housings of the upper plate press against the claws, bending them behind the strip in order to firmly fix the stud on the strip.

The pins of the lower plate are made in one piece from steel.

Generally, the studs are made of steel with a uniform, hard resistant surface coating, such as a nickel-plating, chrome-plating, bluing, gold-plating, etc. For this reason, when the pin of the lower plate is stopped against the surface of the stud, the coating of the stud is not damaged.

However, fashion trends have recently resulted in the production of studs made of steel or plastics and painted with different colors. It must be considered that painting is considerably weaker than electroplating and has an irregular, not perfectly smooth surface.

By carrying out experimental tests on traditional molds, the applicant has discovered that in the case of painted studs in contact with a steel pin, the steel of the pin is practically non-deformable when compressed by the stud. Consequently, irregular parts of the painting of the studs are compressed in a non-uniform way and tend to be detached from the stud, thus impairing the aesthetics of the stud.

DE2512877 discloses an apparatus for applying studs on strips of material using a lower plate with a plurality of upward-protruding pins, an intermediate plate disposed on the lower plate and provided with housings to receive the body of the studs, in such manner that the claws are directed upwards, and an upper plate provided with recessed housings that cooperate with the claws in order to bend the claws.

The purpose of the present invention is to eliminate the drawbacks of the prior art by disclosing an apparatus for applying studs that prevents the studs from being damaged and at the same time is practical, reliable, versatile, inexpensive and simple to make and use.

BRIEF SUMMARY OF THE INVENTION

These purposes are achieved by the present invention with the characteristics of the independent claim 1.

Advantageous embodiments appear from the dependent claims.

The apparatus of the invention is used to apply studs on strips of material. Each stud has a body and attaching means intended to perforate the strip and be attached to the strip. The apparatus comprises:

- a lower plate provided with a plurality of upward-protruding pins,
- an intermediate plate intended to be disposed on said lower plate; said intermediate plate having a plurality of housings intended to receive the body of said studs, so that the attaching means of the studs are directed upwards, said housings of the intermediate plate being through holes to let the pins of the lower plate pass, and
- an upper plate provided with housings disposed in register with said housings of the intermediate plate to cooperate with said attaching means of the studs and attach the studs on the strip, when the studs are pressed between the pins of the lower plate and the housings of the upper plate.

The pins of the lower plate comprise a head made of a soft material, which is intended to be stopped against the body of the studs, in such manner not to damage the body of the studs, when the studs are pressed between the pins of the lower plate and the housings of the upper plate.

The term "soft material" indicates a material with lower hardness than steel and suitable deformability for adjusting to any surface defects of the coating of the stud that comes in contact with the head of the pin of the lower plate.

The advantages of the apparatus according to the present invention are evident, it being extremely versatile because it can be used to apply painted studs of any material, without the risk of damaging the painting.

BRIEF DESCRIPTION OF THE SEVERAL VIEWS OF THE DRAWINGS

Further characteristics of the invention will appear from the following description with reference to a merely illustrative, not limiting embodiment, illustrated by way of example in the attached figures, wherein:

FIG. 1 is an exploded perspective view of the apparatus for applying studs according to the invention;

FIG. 2 is an axial sectional view of a pin of the apparatus of FIG. 1;

FIG. 3 is a perspective view of a stud;

FIG. 4 is a view of the stud of FIG. 3 in overturned position;

DETAILED DESCRIPTION OF THE INVENTION

Figure 5:
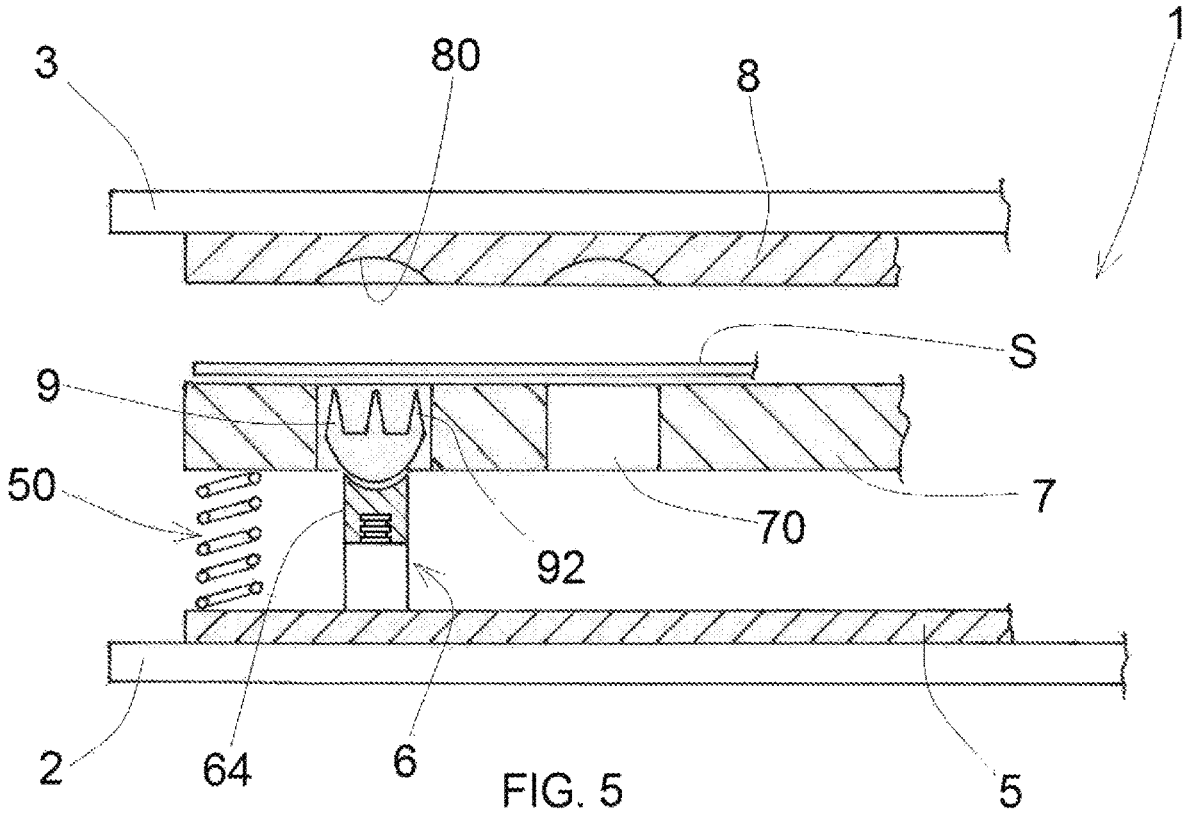
FIG. 5 is a sectional view taken along the vertical sectional plane of the apparatus of FIG. 1 when the mold is closed.

With reference to the Figures, the apparatus according to the invention is disclosed, which is generally indicated with reference numeral (1). The apparatus (1) is used to apply studs (9) (see FIGS. 3 and 4) on a strip (S) (see FIGS. 5 and 6) of different types of materials.

With reference to FIG. 1, the apparatus comprises a base (2) and a lid (3) intended to be pressed onto the base (2). The base and the lid (2, 3) act as die holder plates to receive different types of dies according to the shape and the arrangement of the studs (9) to be applied.

The lid (3) comprises at least one bracket (30) revolvingly connected to the base (2) by means of a hinge (4). In view of the above, by revolving around the axis of the hinge (4), the lid (3) can be pressed under pressure against the base (2).

The lid (3) has a handle (31) in distal position with respect to the hinge (4) in order to be grabbed by a user to actuate the apparatus (1).

Although the attached figures show a manually actuated apparatus wherein base and lid (2, 3) are mutually hinged in order to be opened and closed, the apparatus (1) can be actuated mechanically by means of any type of electric, magnetic, pneumatic or hydraulic actuator. Moreover, instead of being hinged to the base, the lid (3) can be mounted in a traditional vertical or horizontal press.

The apparatus (1) comprises a lower plate (5) intended to be disposed on the base (2). The lower plate (5) comprises a plurality of upward-protruding pins (6). Each pin (60) comprises a head (64) intended to come in contact with the stud (9). The head (64) of the pin is made of a soft material, such as for example plastics, in order not to damage the stud (9) when the head (64) of the pin comes in contact with the stud.

The term "soft material" indicates a material with lower hardness and higher deformability than steel, that is to say a material suitable for adjusting to any surface defects of the coating of the stud (9) that comes in contact with the head (64) of the pin of the lower plate.

The head (64) of the pin of the lower plate is preferably made of plastic material, such as ABS (ACRYLONITRILE BUTADIENE STYRENE). Although it is not shown in the figures, the entire pin (6) of the lower plate can be made of a soft, yet sufficiently rigid material, for example hard plastics, such as ABS.

With reference to FIG. 2, the pin (6) comprises a substantially cylindrical body (60) made of steel and fixed to the lower plate (5). The body (60) of the pin has a shank (61) that protrudes upwards axially. The shank (61) has a lower diameter than the body. The shank (61) is provided with a plurality of collars (62) that protrude radially from the shank in such manner to define undercut portions (63) that act as attachment for the head (64) of the pin.

The head (64) of the pin has a cylindrical shape, with the same diameter as the body (60). The head (64) of the pin has a recessed seat (65) shaped according to the shape of the stud (9), which can be hemispherical, conical, pyramidal and the like.

The head (64) of the pin is fixed to the body (60) of the pin by means of injection molding. The pin (6) is inserted in a cavity of a mold wherein plastic material that forms the head (64) is injected. Evidently, the head (64) can be made as a separate piece from the body (60) of the pin and can be fixed to the body (60) of the pin with other systems, such as for example fit-in coupling, welding, gluing and the like.

The apparatus (1) comprises an intermediate plate (7) intended to be disposed on the lower plate (5). The intermediate plate (70) has a plurality of housings (70) intended to receive the studs (9). The housings (70) of the intermediate plate are through holes. The housings (70) of the intermediate plate are in register with the pins (6) of the lower plate in such manner that the pins (6) can pass through the housings (70). The housings (70) are disposed according to specific patterns that can have different shapes and sizes.

With reference to FIGS. 3 and 4, the studs (9) have a body (90) that can have different shapes, such as hemispherical, conical, pyramidal with square or triangular base, etc. The body (90) of the studs can be coated with surface painting.

The housings (70) of the intermediate plate can have an upper portion with complementary shape and size with the respect to the body (90) of the stud. Therefore the housings (70) of the intermediate plate can have different shapes and sizes to receive studs with different shapes and sizes. For example, the housings (70) of the intermediate plate can have a tapered shape with decreasing dimensions going downwards, in such manner to simplify the insertion of the body (90) of the studs.

The stud (9) has attaching means (91), defined as claws. The attaching means (91) comprise a plurality of bendable feet (92) provided with a tip (93) intended to perforate the strip (S) (see FIGS. 5 and 6) whereon the studs (6) are to be applied. Alternatively, the attaching means (91) of the studs can be fit-in couplings, such as riveting systems.

Going back to FIG. 1, spring means (50) are disposed between the lower plate (5) and the intermediate plate (7), in such way to keep the intermediate plate spaced from the lower plate. When the spring means (50) are unloaded, the head (64) of the pins of the lower plate is situated under the housings (70) of the intermediate plate.

The apparatus (1) comprises an upper plate (8) intended to be fixed to the lid (3). The upper plate (8) comprises a plurality of recessed housings (80) disposed in register with the housings (70) of the intermediate plate. The recessed housings (80) of the upper plate have a perfectly rounded concave shape, like a segment of a sphere, to cooperate with the bendable feet (92) of the studs.

If the attaching means (61) of the studs are riveting systems, the upper plate (8) is provided with housings (80) intended to receive rivets that are coupled with the pins of the studs.

This description continues by illustrating the operation of the apparatus (1).

With reference to FIGS. 1 and 5, a plurality of studs (9) is disposed and distributed on the intermediate plate (7) in such manner that the body (90) of the studs is housed in the housings (70) of the intermediate plate (7) and the attaching means (91) of the studs are directed upwards. If the housings (70) are larger than the studs, the body (90) of the studs is stopped against the head (64) of the pins of the lower plate, in such manner that the studs cannot come out of the intermediate plate.

A strip (S) is disposed on the intermediate plate, above the attaching means (91) of the studs.

Figure 6:
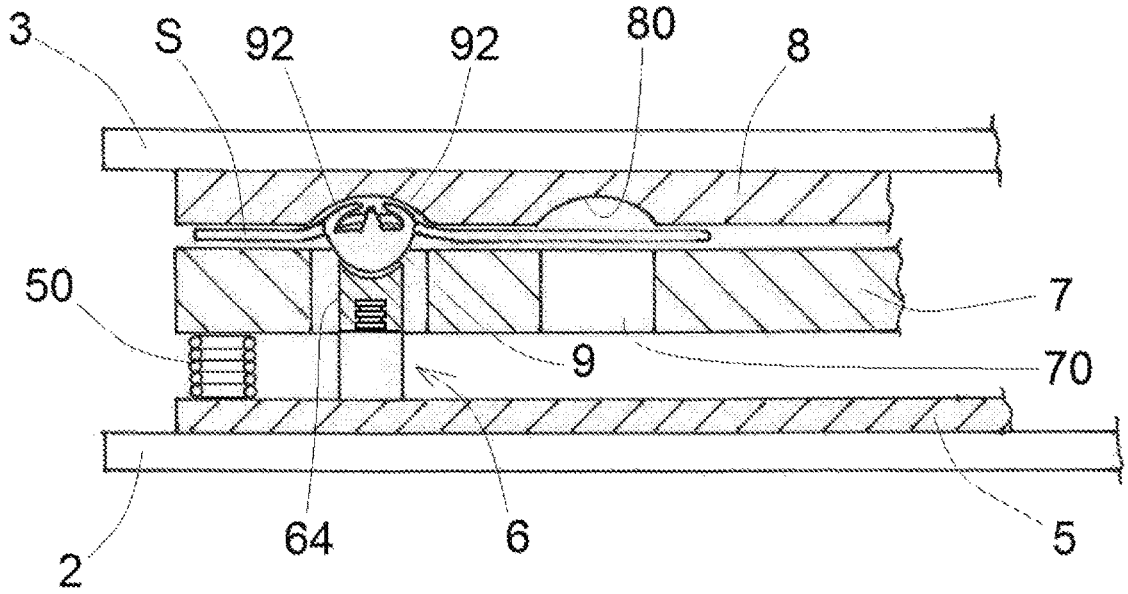
FIG. 6 is the same view as FIG. 5, after closing the mold and applying the stud on a strip.

As shown in FIG. 6, the apparatus is closed, i.e. the lid (3) pushes the upper plate (8) on the intermediate plate (7), in such a way to lower the intermediate plate (7) towards the lower plate (5), compressing the spring means (50). Consequently, the pins (6) pass through the housings (70) of the intermediate plate and the head (64) of the pins (6) holds the body (90) of the studs, holding the studs in position and preventing the studs from being lowered together to the intermediate plate (7).

Considering that the strip (S) is pushed downwards by the upper plate (8), the tips (93) of the feet of the attaching means of the studs perforate the strip (S). Therefore the recessed housings (80) of the upper plate push the feet (92) of the studs downwards, which are bent behind the strip (S) in order to fix the strip (6) firmly.

Considering that the head (64) of the pins of the lower plate is made of a soft material, when the head (64) of the pins of the lower plate is stopped against the body (90) of the studs, the body of the studs is not damaged and in particular the coating is not scratched if the studs are painted.

Numerous variations and modifications can be made to the present embodiment of the invention, within the reach of experts of the field, while still falling within the scope of the invention as claimed in the attached claims.

I claim:

1. An apparatus for applying studs on a strip of material, each of the studs having a body and an attachment element adapted to perforating the strip and attaching to the strip, the apparatus comprising:

a lower plate having a plurality of upwardly-protruding pins, each pin of said plurality of upwardly-protruding pins being a steel body;

an intermediate plate disposed on said lower plate, said intermediate plate having a plurality of housings adapted to receive the body of the studs such that the attachment element are directed upwardly, the plurality of housings being through-holes for passage of the plurality of upwardly-protruding pins of said lower plate;

an upper plate having housings disposed in registration with the plurality of housings of said intermediate plate and adapted to cooperate with the attachment element of the studs so as to attach the studs on the strip when the studs are compressed between the plurality of upwardly-protruding pins of said lower plate and the housings of said upper plate, wherein the plurality of upwardly-protruding pins of said lower plate comprises a head formed of a plastic material and adapted to touch the body of the studs, said upper plate and said lower plate being attached together via a bracket and a hinge in which said upper plate is fixed to a lid and said intermediate plate is disposed on a top of said lower plate, the lid being closeable so as to compress said lower plate and said intermediate plate and said upper plate together; and a plurality of springs in spaced relationship and interposed between said lower plate and said intermediate plate, said plurality of springs affixed to at least one of said lower plate and said intermediate plate, said plurality of springs bearing against at least one of said lower plate and intermediate plate, wherein the shank has at least one collar that protrudes radially from the shank so as to define undercut portions to which the head is attached.

2. The apparatus of claim 1, where the plastic material is injection molded plastic material.

3. The apparatus of claim 1, wherein the body of each pin of said plurality of upwardly-protruding pins of said lower plate is a shank that protrudes axially upwardly.

4. The apparatus of claim 1, wherein the head has a recessed seat adapted to be coupled to the body of the stud.

5. The apparatus of claim 4, wherein the recessed seat has a shape selected from the group consisting of a sphere, a cone, and a pyramid.

6. The apparatus of claim 1, further comprising:

a base receiving said lower plate and said upper plate.

7. An apparatus for applying studs on a strip of material, each of the studs having a body and an attachment element suitable for perforating the strip and attaching to the strip, the apparatus comprising:

a lower plate having a plurality of upwardly-protruding pins;

an intermediate plate disposed on said lower plate, said intermediate plate having a plurality of housings adapted to receive the body of the studs such that the attachment element are directed upwardly, the plurality of housings being through-holes for passage of the plurality of upwardly-protruding pins of said lower plate; and an upper plate having housings disposed in registration with the plurality of housings of said intermediate plate and adapted to cooperate with the attachment element of the studs so as to attach the studs on the strip when the studs are compressed between the plurality of upwardly-protruding pins of said lower plate and the housings of said upper plate, wherein the plurality of upwardly-protruding pins of said lower plate comprises a head formed of an injection molded plastic material and adapted to touch the body of the studs, said upper plate and said lower plate being attached together via a bracket and a hinge in which said upper plate is fixed to a lid and said intermediate plate is disposed on a top of said lower plate, the lid being closeable so as to compress said lower plate and said intermediate plate and said upper plate together; and a plurality of springs in spaced relationship and interposed between said lower plate and said intermediate plate, said plurality of springs affixed to at least one of said lower plate and said intermediate plate, said plurality of springs bearing against at least one of said lower plate and intermediate plate, wherein the body of each pin of said plurality of upwardly-protruding pins of said lower plate is a shank that protrudes axially upwardly, the shank have at least one collar that protrudes radially from the shank so as to define undercut portions to which the head is attached.

8. The apparatus of claim 7, wherein each pin of said plurality of upwardly-protruding pins of said lower plate is a steel body.

9. The apparatus of claim 7, wherein the head has a recessed seat adapted to be coupled to the body of the stud, the recessed seat having a shape selected from the group consisting of a sphere, a cone, and a pyramid.

10. The apparatus of claim 7, further comprising:

a spring interposed between said lower plate and said intermediate plate.

11. The apparatus of claim 7, further comprising:

a base receiving said lower plate and said upper plate.

12. An apparatus for applying studs on a strip of material, each of the studs having a body and an attachment element suitable for perforating the strip and attaching to the strip, the apparatus comprising:

a lower plate having a plurality of upwardly-protruding pins, wherein a body of each pin of said plurality of upwardly-protruding pins is a shank that protrudes axially upwardly;

an intermediate plate disposed on said lower plate, said intermediate plate having a plurality of housings adapted to receive the body of the studs such that the attachment element are directed upwardly, the plurality of housings being through-holes for passage of the plurality of upwardly-protruding pins of said lower plate;

an upper plate having housings disposed in registration with the plurality of housings of said intermediate plate and adapted to cooperate with the attachment element of the studs so as to attach the studs on the strip when the studs are compressed between the plurality of upwardly-protruding pins of said lower plate and the housings of said upper plate, wherein the plurality of upwardly-protruding pins of said lower plate comprises a head formed of a plastic material and adapted to touch the body of the studs, said upper plate and said lower plate being attached together via a bracket and a hinge in which said upper plate is fixed to a lid and said intermediate plate is disposed on a top of said lower plate, the lid being closeable sous to compress said lower plate and said intermediate plate and said upper plate together; and a plurality of springs in spaced relationship and interposed between said lower plate and said intermediate plate, said plurality of springs affixed to at least one of said lower plate and said intermediate plate, said plurality of springs bearing against at least one of said lower plate and intermediate plate, wherein the shank has at least one collar that protrudes radially from the shank so as to define undercut portions to which the head is attached.

13. The apparatus of claim 12, wherein each pin of said plurality of upwardly-protruding pins of said lower plate is a steel body.

14. The apparatus of claim 12, wherein the head has a recessed seat adapted to be coupled to the body of the stud, the recessed seat having a shape selected from the group consisting of a sphere, a cone, and a pyramid.

15. The apparatus of claim 12, further comprising:

a base receiving said lower plate and said upper plate.

* * * * *